United States Patent [19]

Moore

[11] 3,998,358

[45] Dec. 21, 1976

[54] APPARATUS FOR DISPENSING ARTICLES SUCH AS NEWSPAPERS AND THE LIKE

[76] Inventor: Harry O. Moore, Rte. No. 2, Norman Shores, Huntersville, N.C. 28078

[22] Filed: Sept. 23, 1975

[21] Appl. No.: 615,939

Related U.S. Application Data

[63] Continuation-in-part of Ser. No. 449,385, March 8, 1974, Pat. No. 3,907,160.

[52] U.S. Cl. ..... 221/91

[51] Int. Cl.[2] ..... G07F 11/32

[58] Field of Search ..... 221/90, 91, 89; 194/2

[56] References Cited

UNITED STATES PATENTS

| | | | |
|---|---|---|---|
| 378,945 | 3/1888 | Alexander-Katz | 221/91 X |
| 759,977 | 5/1904 | Estberg | 221/91 |
| 2,351,779 | 6/1944 | Niewoehner | 221/91 X |

FOREIGN PATENTS OR APPLICATIONS

| | | | |
|---|---|---|---|
| 1,140,341 | 1/1969 | United Kingdom | 221/91 |

*Primary Examiner*—Stanley H. Tollberg
*Attorney, Agent, or Firm*—Wellington M. Manning, Jr.

[57] ABSTRACT

An improved apparatus for dispensing articles such as newspapers, magazines and the like is disclosed and claimed herein. The dispensing apparatus includes a housing in which the articles are separately supported in superposed fashion, being downwardly inclined in compartments therefor, awaiting dispensing one by one. Pliable restraining means are in engagement with the article and moveable out of engagement with the article to permit gravitational dispensing of same. Movement of the pliable restraining means is incrementally provided by an amount sufficient to permit dispensing of a single article. Actuation is accomplished by a predetermined coin deposit, or the like. Suitable pliable restraining means may include, without limitation, chains, steel tapes, wires, plastic strips and the like.

15 Claims, 12 Drawing Figures

APPARATUS FOR DISPENSING ARTICLES SUCH AS NEWSPAPERS AND THE LIKE

CROSS-REFERENCE TO RELATED APPLICATION

This application is a continuation-in-part of application Ser. No. 449,385, filed Mar. 8, 1974 in the name of Harry O. Moore and entitled APPARATUS FOR DISPENSING ARTICLES SUCH AS NEWSPAPERS AND THE LIKE, now U.S. Pat. No. 3,907,160.

BACKGROUND OF THE INVENTION

As is well known, most conventional coin-operated newspaper vending machines in general use today are of a type having a normally locked door hingedly mounted along its lower edge which is unlocked and released by inserting in an associated coin mechanism a coin or coins sufficient to pay for a single newspaper. When the door is released by the coin mechanism, the customer swings the door downwardly to open same and thus gains access to a stack of newspapers in the machine. Generally, the customer will take a single newspaper from the stack and thereafter permit the door to return under spring pressure to its closed and locked position. It has been determined, however, that some customers will insert a sufficient amount into the coin mechanism to pay for a single newspaper, but will then remove more than the one newspaper from the stack in the machine. In fact, occasionally a customer will remove all remaining newspapers from a vending machine once the door has been opened, even though only a single newspaper may have been purchased.

Another drawback of such conventional types of newspaper vending machines reside in the fact that, as indicated above, the door is normally urged toward closed position by a spring means. A considerable force is applied to the door, and is present in progressive amounts as the door is moved toward its fully open position. Accordingly, after a customer removes a newspaper from the vending machine and releases the open door of the machine, the spring means causes the door to return rapidly to its closed position under relatively high pressure. The door thus closes in a violent manner and hence produces considerable noise. Not only can such closing noise irritate the customer or some other person who may be nearby, such violent closing of the door could also cause injury in the event that an arm or hand is in the path of travel of the door during its return to the closed position. Moreover, continued physical impact of the door during closing could cause damage to the dispensing unit, per se.

Prior attempts have been made to provide a dispensing apparatus that overcomes the aforementioned problems. Certain of these improved units have met with some success such as the type described in the aforementioned parent application. Further improvements are, however, still possible. The dispensing apparatus of the present invention affords such improvements in providing a device that will dispense single articles; is simple to operate; and will enjoy a long, maintenance-free life under normal operating conditions. No known prior art anticipates the apparatus of the present invention. Exemplary of the known prior art are U.S. Pat. Nos. 378,945 to Katz; 517,412 to Martel; 895,899 to Schenck; 1,744,112 to Frey; 2,099,344 to Mills; 2,351,779 to Niewoehner, and 3,425,596 to Marczak et al.

SUMMARY OF THE INVENTION

It is an object of the present invention to provide an improved apparatus for dispensing newspapers and the like, which is of simple and economical construction, and has the required operating mechanisms and the newspaper supporting means thereof so arranged therein that there is no need for a customer to open a door to obtain a newspaper from the apparatus, and also wherein, upon insertion of a coin or coins into a coin mechanism thereof sufficient only to pay for a single newspaper, only a single newspaper may be dispensed while other newspapers remain inaccessible to the customer.

It is a further object of the present invention to provide an improved apparatus for dispensing newspapers from one and of a compartmentalized stack of newspapers, wherein a pliable restraining means is incrementally moved in a dispensing direction, away from the article to be dispensed, after which a single article moves, by gravity, from its compartment and into a dispensing slot where it can be removed.

According to yet a further object of the invention, a pliable restraining means is removeably positioned in front of dispensing compartments and is then incrementally moved in a desired direction to uncover the front end of the next compartment whereby an article therein falls by gravity to a dispensing chute for removal by a customer.

Still another object of the present invention is to provide a dispensing apparatus where pliable restraining means are removeably positioned along opposite edges of the front of a plurality of dispensing compartments and are incrementally wound onto a stationary, rotatable shaft to uncover the front ends of the compartments one at a time, and permit dispensing therefrom.

Yet another object of the present invention is to provide pliable restraining means in front of a dispensing compartment and forming a part of a closed loop, and incrementally moving the restraining means around the closed loop, exposing one dispensing compartment at a time.

Generally speaking, the dispensing apparatus of the present invention comprises a housing; support means received in said housing for separately receiving and holding articles to be dispensed, said articles being maintained at a downwardly inclined angle to permit gravitational dispensing when unrestrained; pliable restraining means located adjacent a dispensing end of said support means and being in engagement with said articles to be dispensed; and a stationary, rotatable shaft located adjacent one end of said article supporting means and being drivingly associated with said pliable restraining means, said shaft being rotatable upon actuation of said apparatus to drive said restraining means by a predetermined amount whereby one article only becomes unrestrained and is dispensed.

More specifically, inclined dispensing compartments are covered in part at a lower, dispensing end by a pliable restraining means removeably positioned thereat. The pliable restraining means, preferably positioned along both edges of the compartments, have elongated connector means secured thereto to hold the ends of the restraining means while not interfering with dispensing when presented in front of the dispensing compartments. In general therefore, the elongated connector means are not as wide as the restraining means.

Restraining means according to the present invention may be any material that will withstand the pressure of the articles thereon and will negotiate sufficient curves to be incrementally moved away from the front of the dispensing compartments. Suitable examples include chains, steel tapes, plastic tapes, wires secured together along a rear side, and the like. In one embodiment, the restraining means is wound onto a stationary, rotatable shaft during dispensing with an opposite end being secured to a cable means which also is wound onto a shaft, preferably the same one, such that a winding of either the restraining means or the cable means causes a like opposite operation of the other. A further embodiment finds the cable means secured to both ends of the restraining means and passing around the article support means, being appropriately guided by a plurality of guides, at least one of which is in driving engagement with either the restraining means or the cable means.

As will be described in detail hereinafter, the restraining means are moved by incremental amounts, exposing one dispensing compartment at a time, including means for achieving the incremental movement, actuation means, and the like.

DESCRIPTION OF THE PREFERRED EMBODIMENTS

Figure 1:
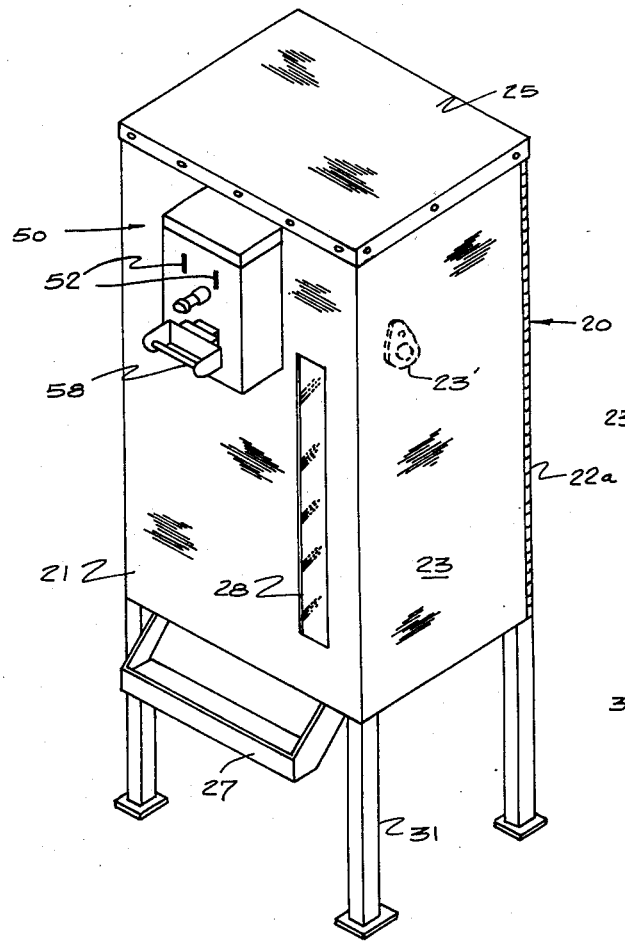
FIG. 1 is a frontal perspective view of dispensing apparatus according to the present invention.
Figure 2:
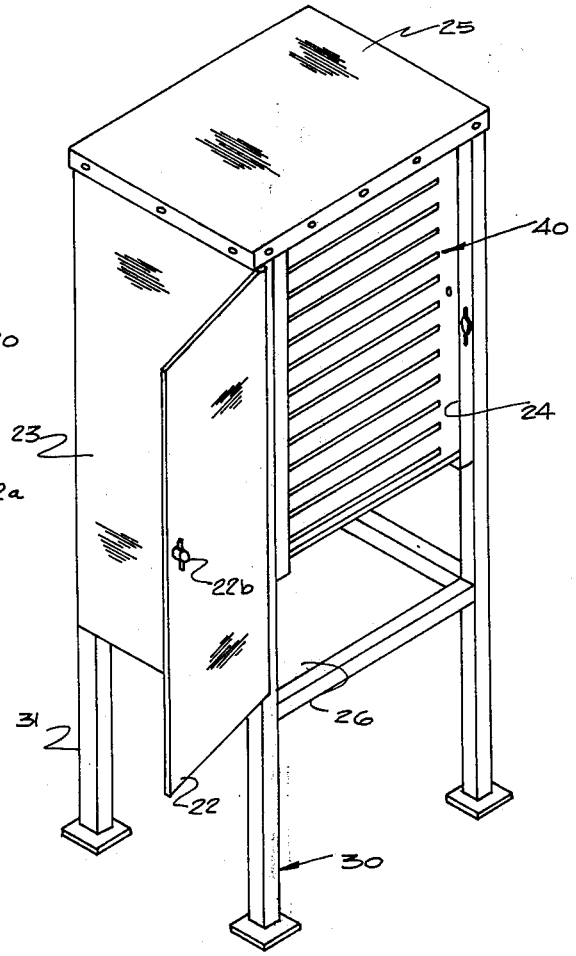
FIG. 2 is a rear perspective view of dispensing apparatus according to the teachings of the present invention, with a rear access service door thereof shown in an open position.
Figure 3:
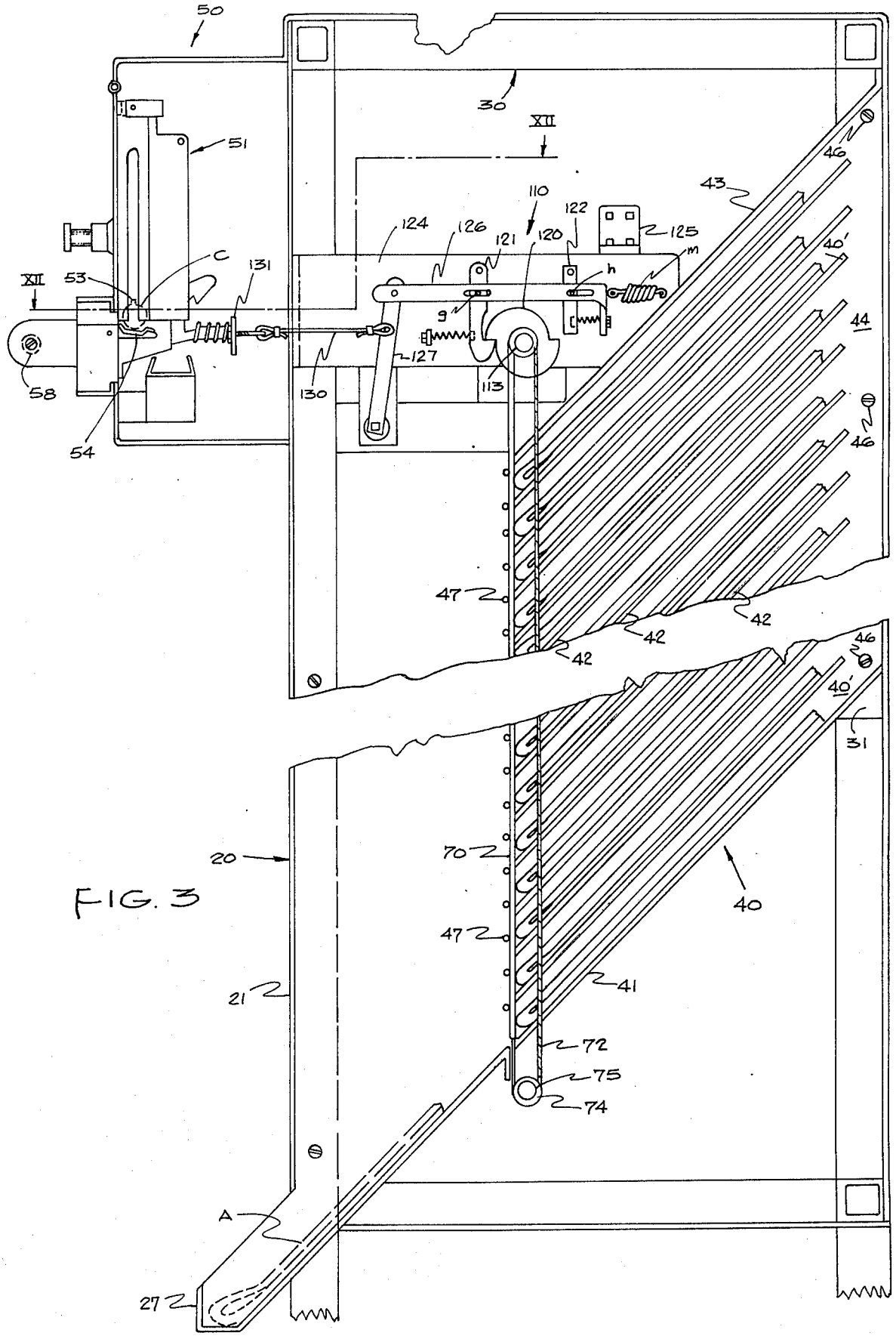
FIG. 3 is a vertical sectional view through a coin-operated newspaper dispensing apparatus according to the present invention illustrating newspaper supporting means filled with newspapers with restraining means being shown thereagainst, holding the newspapers in their respective compartments.

Referring more specifically to the drawings, the article dispensing apparatus of the present invention will now be described in detail. The apparatus comprises a cabinet or housing 20 having front and rear walls 21 and 22, opposing side walls 23 and 24, a top wall 25 and a bottom wall 26, all secured to a suitable frame broadly designated as 30. Only pertinent parts of the frame 30 will be mentioned hereinafter. As shown in FIGS. 1, 2 and 3, bottom wall 26 may be spaced from the lower portion of frame 30 so that corner frame members of frame 30 form supporting legs 31 for housing 20. Rear wall 22 of housing 20 is hingedly connected, as at **22*a* along one longitudinal or vertical edge thereof, to a rear edge of side wall 23 and serves as a door for gaining access to the interior of housing 20 for loading articles such as newspapers, magazines and the like, into an article supporting means or compartmented storage unit broadly designated at 40 which will be further described hereinafter. Rear wall 22 may be releasably secured in a closed position by a suitable lock means 22*b*. A glass 28 received in front wall 21 of housing 20 permits observation therethrough of article support means 40** to ascertain whether any newspapers are therein. Since the present apparatus is particularly devised for dispensing newspapers, the articles to be dispensed will be termed as newspapers hereinafter, though again, it is to be understood that other articles may be dispensed therefrom, particularly magazines.

The front upper portion of housing 20 has a relatively small enclosure or auxiliary housing 50 suitably secured thereon which contains a coin receiving mechanism generally designated as 51. Coin receiving mechanism 51 may be conventional and is illustrated as being a type substantially as disclosed in U.S. Pat. Nos. 3,174,608 and 3,265,177 to Knickerbocker dated Mar. 23, 1965 and Aug. 9, 1966, respectively, and to which reference is made for a more detailed disclosure thereof. A detailed description of the coin mechanism 51 will thus not be given herein, it being deemed sufficient to state that the lower portion of the coin mechanism 51 is capable of receiving coins through one or more slots 52 properly positioned in the upper portion of the coin mechanism 51. As illustrated in FIG. 3, a coin C is restrained from upward movement by a moveable retainer 53 and is operably to cam a pivoted latch plate 54 into an operative position. Latch plate 54 may then be pulled forwardly relative to auxiliary housing 50 a sufficient distance to effect a dispensing operation. Since the coin operation feature is conventional and is more particularly described in the parent application, no further description of same will be afforded at this point. Suffice it to say that the dispensing mechanism of the present invention remains inoperative until receipt of the required coin or coins in the coin receiving mechanism 51.

A locking and releasing mechanism of the type shown in FIGS. 1, 3 and 5–8 generally indicated as 110 may be utilized for controlling the dispensing operations. Such a locking and releasing mechanism requires that the hand-operated actuator 58 be pulled outwardly a predetermined distance and then returned to substantially its original illustrated rest position in order to effect a complete dispensing operation. This operation will be fully described hereinafter. Other types of locking and releasing mechanisms may, however, be employed with the present apparatus as described in the parent application.

Making reference to FIG. 3, it will be seen that the article supporting means generally indicated as 40 is a generally self-contained storage unit comprising a plurality of vertically arranged, forwardly and downwardly inclined article-receiving compartments 40'. Dispensing compartments 40' are defined by vertically spaced, substantially parallel, forwardly and downwardly inclined walls or shelves each being adapted to support thereon an article to be dispensed. The inclined walls of storage unit 40 may be of any desired construction; e.g., they may be formed from spaced strips of material, spaced rods, or solid or perforated sheets of rigid material, as desired. As shown, the compartments are defined by an inclined main or bottom wall 41 and a plurality of superposed inclined auxiliary walls 42 spaced above the bottom wall 41. A top forwardly and downwardly inclined plate member 43 is spaced above the uppermost auxiliary wall 42 and constitutes the top wall of the article storage unit 40. Opposite side edges of all of the article storage walls 41, 42 and top wall 43 are suitably secured to opposing side wall members 44.

The front edges of all the inclined walls 41, 42 and 43 are preferably substantially flush with the vertically extending front edges of the opposing side wall members 44. Bottom inclined wall 41, top inclined wall 43 and opposing side wall members 44, however, preferably extend rearwardly beyond the rear edges of the auxiliary supporting walls 42 so that the rear edges of auxiliary walls 42 are spaced forwardly of the rearmost wall or door means 22 of main housing 20 when the article storage unit 40 is properly installed in main housing 20 of the present dispensing apparatus.

Figure 10:
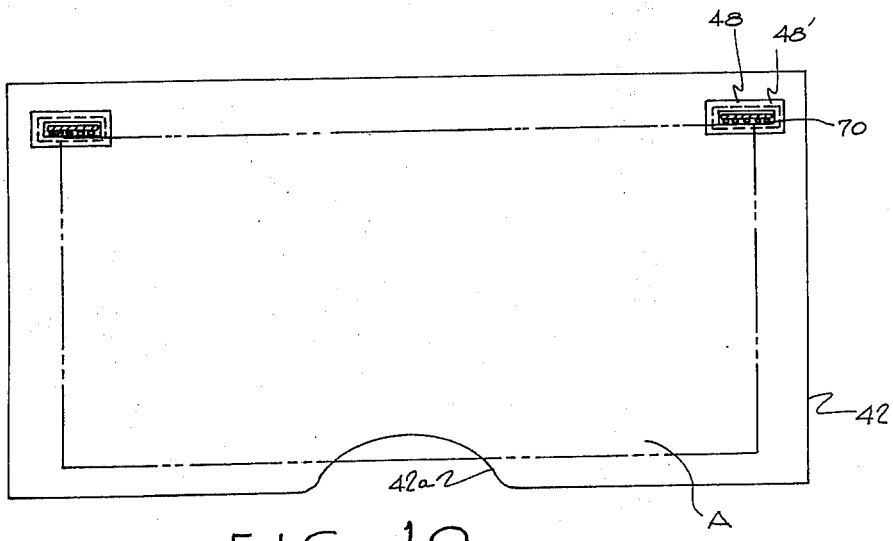
FIG. 10 is a top plan view of a portion of the article support means illustrating restraining means guide slots therein.

Preferably, article storage unit 40 is removeably secured in housing 20 so that storage unit 40 may be readily removed and replaced with a similar, loaded article storage unit 40, not shown, in the event it is desirable to load storage units with newspapers at a location remote from the dispensing apparatus, such as at a printing establishment. It also is preferred that each of the auxiliary supporting walls 42 is provided with a substantially centrally located recess or cutaway **42*a* in its central rear edge portion (FIG. 10). Insertion and removal of newspapers A from article receiving compartments 40' through the rear opening of housing 20 is thus facilitated. As heretofore described, the rear opening in housing 20 is closed by the rear wall or door means 22 when the dispensing apparatus is conditioned for the customers' use. To facilitate the installation and removal of the article storage unit 40 with respect to housing 20, opposite side wall members 44 of the article storage unit 40 may be secured, as by screws 46 (FIG. 3) or suitable quick release fixtures, to an appropriate member 31 of housing frame 30**.

Figure 4:
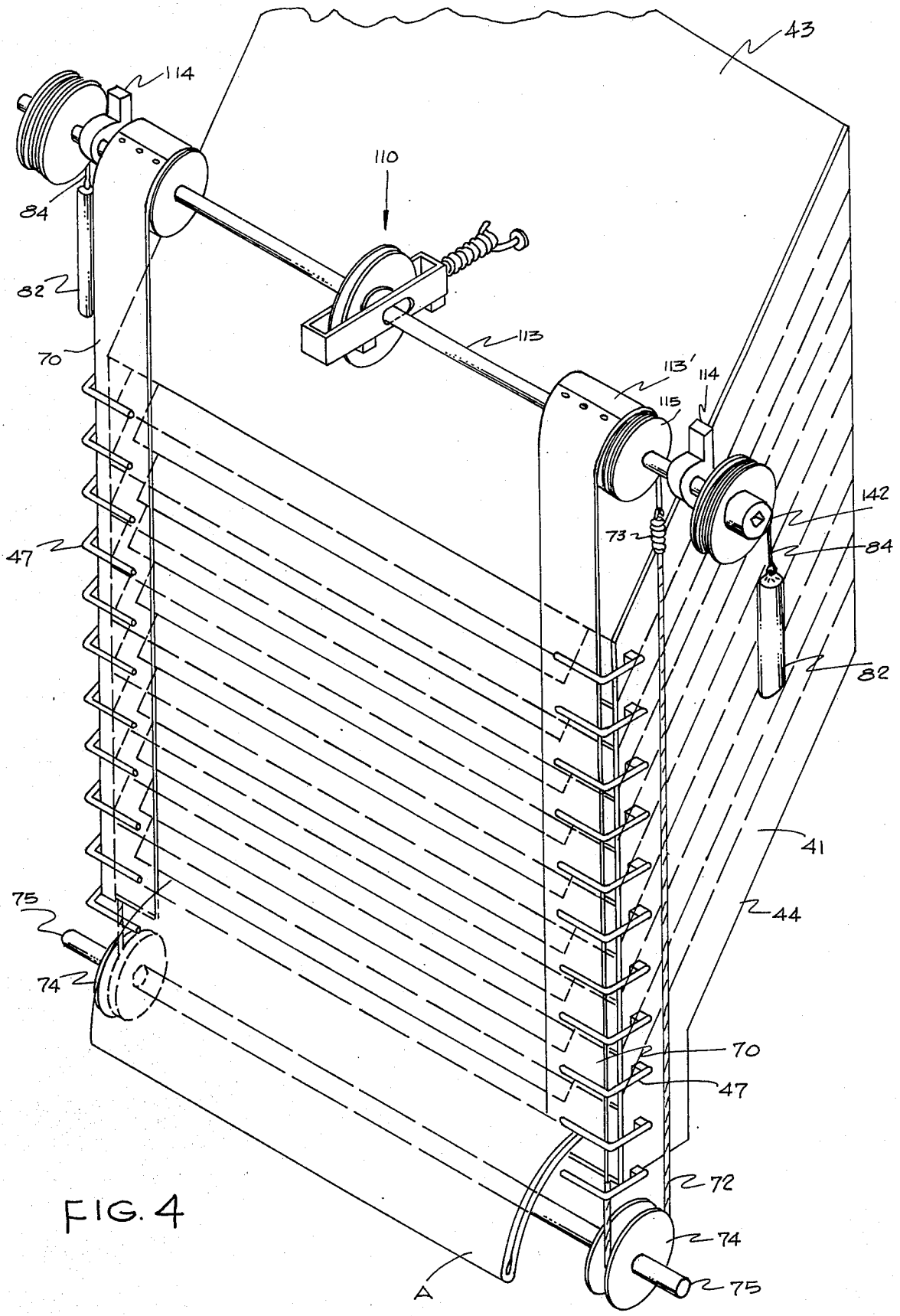
FIG. 4 is an isometric view of support and restraining means of an embodiment of the present dispensing apparatus, illustrating a relationship therebetween.

Positioned in front of dispensing compartments 40' is a pliable article restraining means 70 which is incrementally moveable in either direction to uncover dispensing compartments 40', one at a time, and permit gravity dispensing of the newspapers or other articles therefrom. As illustrated in FIGS. 3 and 4, restraining means 70 is preferably a tape which may be constructed of any material which will withstand the pressures produced thereon by a full complement of newspapers and still be incrementally moveable to facilitate dispensing from the individual compartments 40'. The tape or other type restraining means 70 is preferably several inches wide, and extends inwardly along compartment 40' a sufficient distance to thwart dispensing of the particular article therefrom. Excessive contact between the restraining means and the article would provide too great a combined frictional and pressure force against the restraining means and should be avoided. Note that restraining tape 70 is maintained at the dispensing end of compartments 40' by a series of spaced guides 47 secured to support 40 along the height thereof. As further shown in FIG. 10, walls 41, 42 and 43 that define the lower and upper extremities of compartments 40' may have guide slots 48 provided therein. In either embodiment, the guiding contact surfaces are preferably covered with a material having a low frictional resistance such as a polytetrafluoroethylene (PTFE) material. Guides 47 of FIGS. 3 and 4 could be produced from PTFE while in FIG. 10, strips 48' may be provided in guide slots 48.

Restraining means 70, as illustrated in FIGS. 3 and 4, is secured to a shaft 113 which is appropriately journaled for rotation in bearings 114. Shaft 113 is thus stationary with respect to support means 40 and through rotation produces a corresponding linear movement of restraining means 70 in front of dispensing compartments 40'. Shaft 113, as will be described in more detail hereinafter is loaded for rotary movement as exemplified by a weight 82 suspended from an elongated element 84 that is wrapped around a portion of shaft 113, and continuously applies a torque against shaft 113 so long as element 84 remains wound onto shaft 113. A prestressed spring around shaft 113, or some other similar arrangement could also provide a rotary bias on shaft 113. A shaft brake means such as the locking and releasing mechanism generally indicated as 110 should be provided to permit limited rotation of shaft 113 only when dispensing is desired. Restraining means 70 should thus have an association with a suitable drive means which is preloaded, for rotary motion, but braked, and released only for limited rotation to permit incremental movement of restraining means, or with a drive means that is actuatable only during a dispensing cycle. The drive means may accordingly be positioned above or below compartments 40' whereby dispensing may occur from top to bottom or vice versa.

In the particular embodiment shown in FIGS. 3 and 4, restraining tape 70 is secured around rotatable shaft 113 to be wound thereon and permit dispensing from compartments 40', starting at the bottom and moving up. An opposite end of tape 70 has a cable 72 secured thereto. Cable 72 passes around a guide roller 74 that is received on a shaft 75 and upwardly to a pulley 115 on shaft 113, where it is secured adjacent tape 70. Cable 72 has a spring 73 therealong at shaft 113 to withdraw cable 72 during resetting of the dispensing apparatus. Alternatively, cable pulley 115 may be spring loaded to apply continued tension on cable 72 during the dispensing operation. Actuation of the one way clutch locking and releasing mechanism 110 temporarily releases shaft 113, permitting weight 82 to fall a preset distance and impart rotation (clockwise in FIGS. 3 and 4) to shaft 113 to wind up a proportionate length of tape 70. As soon as weight 82 stops its descent, rotation of shaft 113 ceases, being held by the locking and releasing mechanism 110. During upward movement of tape 70, the next lowermost compartment 40' is uncovered, whereby the newspaper A therein is no longer restrained, and slides off wall 42 into dispensing chute 27 for removal by the customer. A newspaper A is shown falling from its compartment 40' in FIG. 4. In this fashion, tape 70 moves upwardly so long as compartments 40' are loaded with a newspaper.

As shown in the Figures, it is preferred that the forward edges of storage walls 41, 42 are positioned closely adjacent the substantially vertical path of travel of the rear edges of restraining means 70 to insure that the folded leading or lower edges of corresponding newspapers A will not bend downwardly and become wedged between restraining means 70 and the front edges of the adjacent inclined walls during the course of successive stepwise movements of restraining means 70.

Figure 11:
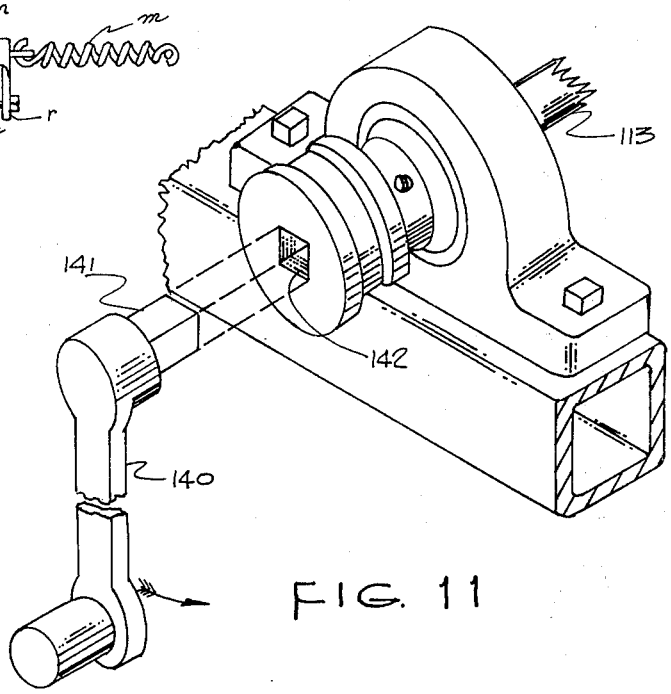
FIG. 11 is a fragmentary view of a crank means for resetting the restraining means of the present invention to close the dispensing compartments.

After completion of dispensing at which point all compartments 40' are empty or whenever remaining newspapers are removed and the next edition loaded therein, tape 70 may be returned to its original position where all of the compartments 40' are blocked and a newspaper A will remain therein. Any convenient method for resetting the apparatus is acceptable. One technique is illustrated in FIG. 11. Shaft 113 has a socket 142 at an end thereof, with access to socket 142 being available through reset opening 23' in side wall 23 of housing 20 (FIG. 1). A handle 140 is provided having a lug 141 thereon that is receivable in socket 142. By turning handle 140 in a counter clockwise direction shaft 113 is reversed and tape 70 unwound therefrom due to spring tension on cable 72.

A preferred embodiment of the locking and releasing mechanism 110 is illustrated in FIGS. 5–8. The relationship of the diameter of the wind up portion 113' of shaft 113, with respect to the distance between the upper surfaces of the front edges of adjacent supporting walls or shelves 41, 42 is such that shaft 113 rotates one-half a revolution in order for restraining means 70 to move such a distance to permit egress of a newspaper A from its compartment 40'. It will be observed in FIGS. 3 and 5–8 that a medial portion off shaft 113 has a rotor means 120 secured thereon which is provided with a substantially diametrically opposed pair of radially extending latch engaging surfaces *a* and *b*, which are successively engaged by a first latch means 121 and a second latch means 122, and which are interconnected by suitable guide surfaces or cam surfaces *c* and *d.*

The two latch means 121 and 122 extend upwardly and are pivotally connected, as at *e* and *f* to a stationary support plate 124. The front end of support plate 124 is suitably secured to the inner surface of the front wall 21 of main housing 20 and the rear portion of plate 124 is suitably secured to a transverse frame member 125 which extends between and is suitably secured to housing side walls 23 and 24.

Figure 12:
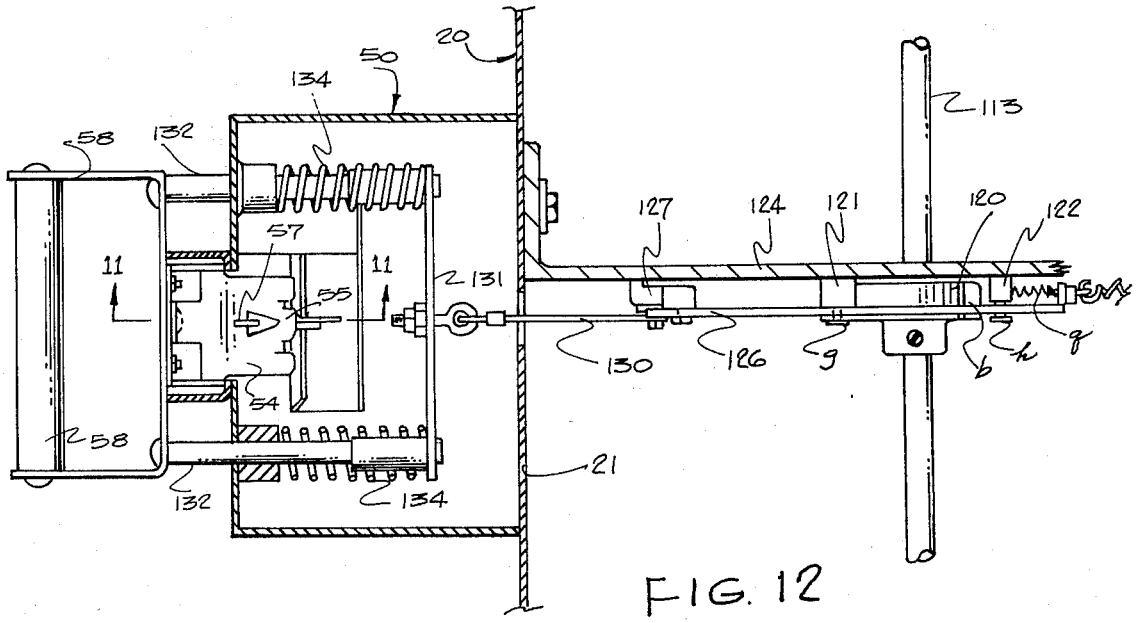
FIG. 12 is a fragmentary plan view, partially in section, taken substantially along a line XII—XII in FIG. 3.

Medial portions of latch means 121 and 122 have respective outwardly projecting pins or followers *g* and *h* thereon which loosely penetrate respective longitudinally extending slots *i* and *j* in a control arm 126. As shown in FIG. 1, the front portion of control arm 126 is pivotally connected to the upper portion of a lever 127 pivotally mounted on a lower depending portion of support plate 124. Lever 127 has the rear end of a link or cable 130 connected thereto whose front end is suitably connected to a yoke 131. Yoke 131 (FIG. 12) is connected to hand-operated actuator 58 by means of a pair of forwardly and rearwardly extending and laterally spaced roes 132 guided for forward and rearward movement in suitable slides or bearings carried by the front wall of auxiliary housing 50. The inner or rear portions of guide rods 132 are surrounded by compression springs 134 arranged to normally urge yoke 131, and thus the hand-operated actuator 58, rearwardly to the normally inactive position shown in FIGS. 1 and 3. It should be noted that, when actuator 58 occupies the normally inactive or rest position, the reel restraining means, embodied in first match means 121, is in a normally active state; i.e., latch means 121 is engaging one of the surfaces *a* or *b* of rotor 120.

Control arm 126 is normally biased rearwardly or to the right by a tension spring *m*. The lower portion of first latch means 121 is urged rearwardly or from left to right in FIGS. 3 and 5–8 by a compression spring *n* which bears against a stationary abutment *p* carried by support plate 124. The lower portion of second latch means 122, however, is urged forwardly or from right to left in FIGS. 3 and 5–8 by a compression spring *q* which bears against a moveable abutment *r* carried by the rear portion of and moveable with control arm 126.

Figure 5:
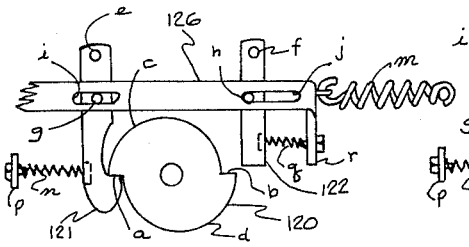
FIGS. 5–8 are fragmentary views of one embodiment of a locking and releasing mechanism associated with a rotatable shaft for incrementally moving the pliable restraining means along the dispensing compartments upon operation of a manually operable actuator, showing successive stages during operation of the locking and releasing mechanism.
Figure 6:
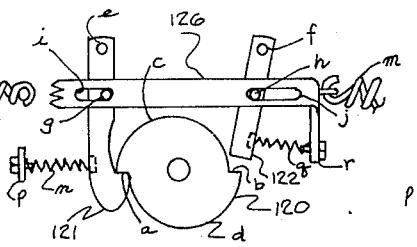
Figure 7:
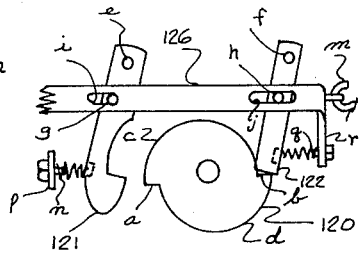

The slots *i* and *j* are different lengths with respect to each other and are so located that, while the locking and releasing mechanism 110 is active and at rest as shown in FIGS. 3 and 5, pin *g* of first latch means 121 occupies an intermediate position with respect to the opposing ends of the slot *i*, but pin [h of second latch means 122 occupies a position in engagement with the left-hand end of slot *j*, with the result that latch means 121 is in latching engagement with the latch engaging surface *a*, but latch means 122 is disposed rearwardly of the latch engaging surface *b*. Thus, the locking and releasing mechanism thus described serves as a normally operative restraining means against rotation of shaft 113.

Figure 9:
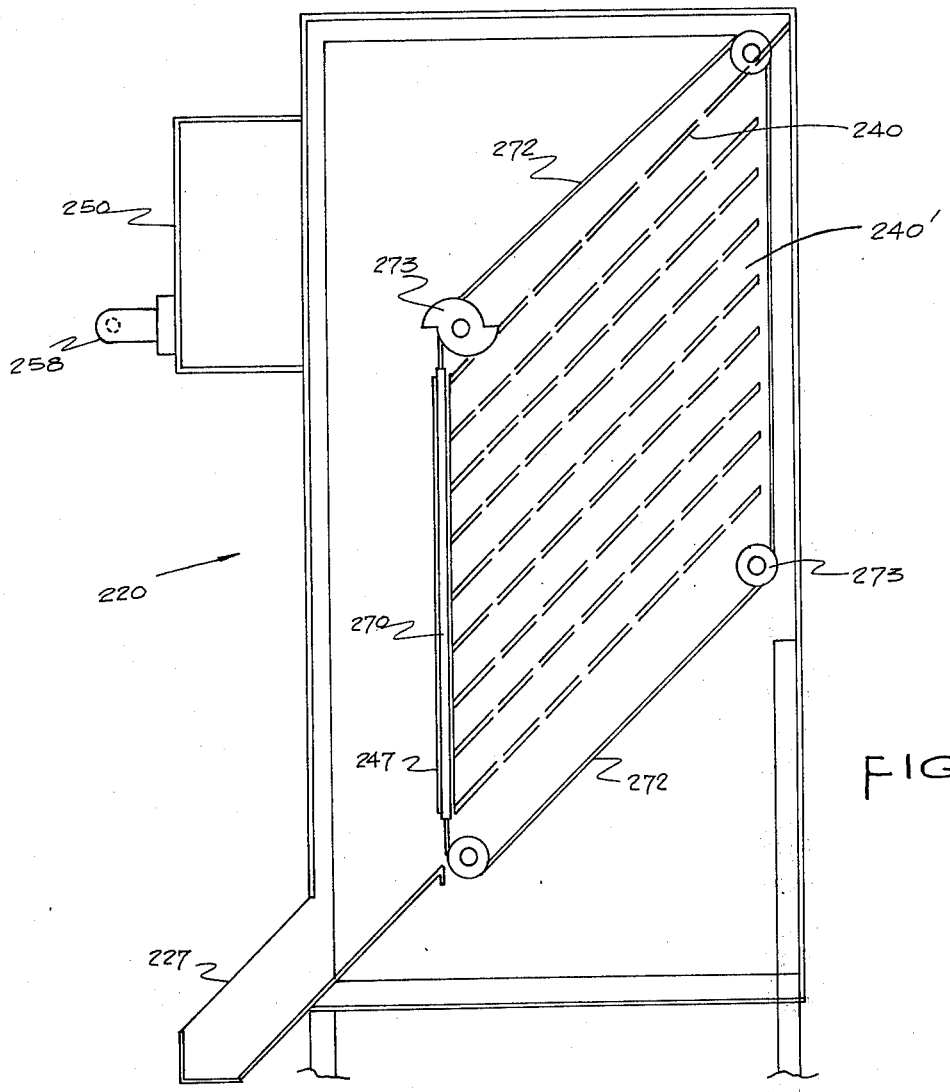
FIG. 9 is a fragmentary side cross sectional view of the dispensing apparatus as shown in FIGS. 3 and 4, illustrating a further embodiment of the restraining means.

FIG. 9 illustrates yet another embodiment of the dispensing apparatus of the present invention. A pliable restraining means 270 is removeably positioned immediately in front of a plurality of article compartments 240' of a support means 240, and behind a guide member 247. While guides 47 of FIGS. 3 and 4 are illustrated as individual spaced apart members, guide 247 is solid during the height of support 240, holding restraining means 270 against the dispensing end of compartments 240'. Obviously guide 247 must not extend over into the path of an article being dispensed, whereby restraining means 270 will necessarily be the wider of the two.

Also in FIG. 9, restraining means 270 has a cable or other elongated element 272 secured to opposite ends thereof with the two passing around a plurality of rolls or pulleys 273, one or more of which may be drive rolls with the remainder being for guiding purposes only. For example, the driving relationship could be based on a frictional engagement between cable 272 and one of the rear pulleys 273; could be based on a sprocket arrangement where a plurality of holes are provided in the restraining tape, or the like. Likewise, while a manual operation has been described hereinabove, an electric motor drive could be provided for one of the pulleys 273. In the tape-cable arrangement of FIG. 9, no spring loading is necessary for applying tension on the system and insuring proper return of the tape and cable to a loaded position. Instead, each move of tape 270 or cable 272 is followed by a like move of the other. Reloading could be accomplished as described with respect to FIG. 11 or otherwise. Restraining tape 270 could thus be driven in a clockwise direction as illustrated in FIG. 9 whereby the lower compartments 240' would dispense first or in a counter clockwise direction, whereby the top compartments 240' would dispense first.

The remaining mechanisms such as the drive source for the pulleys, a locking and releasing mechanism, the coin mechanism, and the like will certainly be necessary for a dispensing unit utilizing the closed loop restraining system of FIG. 9. These items could be as described with respect to the embodiments of FIGS. 3 and 4 and are not further described at this point.

The pliable restraining means hereunder have been defined as including chains. The chain structure as defined in the parent application would suffice, though the rotational direction of the stationary, rotatable shaft would be reversed to accommodate the one way bend of the chain. Likewise, a flexible steel tape is suitable and generally would be about 3 inches in width. Plastic tapes could also be suitable if the tape can negotiate the curves while returning the requisite strength to hold the articles and be incrementally moveable thereby. Frictional engagement between the articles and the tape is important. Less surface area contact with the articles is thus a preference. The steel tapes, for example, could be perforated. Likewise, as illustrated in cross section in FIG. 10 a tape could be employed where a plurality of spaced elements make contact with the articles being held for dispensing. Such a structure could involve a plurality of wires secured to a suitable backing. Still further, other pliable restraining means may be suitable so long as the requisite qualities for same are met.

In operation, therefore, assuming that a coin C is properly positioned in coin mechanism 51 as indicted in FIG. 3, it follows, that a customer may pull the hand-operated actuator 58 outwardly, or from right to left, in FIG. 3. With movement of actuator 58 from right to left control arm 126 is also moved from right to left from the position of FIGS. 3 and 5 to the position of FIG. 6. Pin *h* is permitted to move forwardly in engagement with the front surface of the slot *j* of control arm 126 whereby spring *q* may move second latch means 122 into the circular plane or path of second latch engaging surface *b*.

Figure 8:
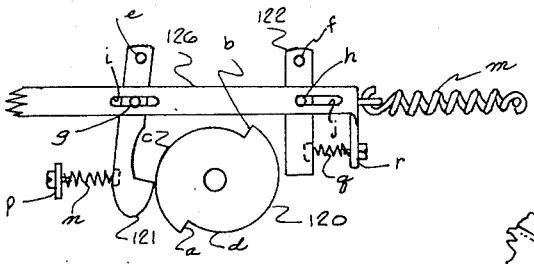

With further forward movement of control arm 126, the pin *g* of latch means 121 is engaged by the rear surface of slot *i* to move first latch means 121 out of engagement with the corresponding latch engaging surface *a*. Thereupon, weight 82 moves downwardy imparting a clockwise rotary motion to shaft 113, caused by unwinding of element 84. Such movement of rotor 120 is relatively short, only a small fraction of a half revolution of rotor 120. In the course of rearward movement of the actuator 58, following a predetermined forward movement thereof to the extent required in order to withdraw first latch means 121 out of engagement with the corresponding latch engaging surface *a* of rotor 120, spring *m* then will pull the control arm 126 rearwardly to such extent that the front surface of the rear slot *j* in control arm 126 will engage and impart rearward movement to second latch means 122, as shown in FIG. 8. Latch means 122 is thus moved out of engagement with the latch engaging surface *b* and rotor 120 resumes rotation until the latch engaging surface *b* thereon subsequently moves back into engagement with the first latch means 121. The parts again occupy the active or rest position shown in FIGS. 3 and 5. Of course, as the surface *b* approaches latch means 121, the remaining movement of restraining means 70 coincident with rotation of shaft 113 occurs to clear the next lower dispensing compartment 40' and permit the newspaper A therein to slide out and into dispensing chute 27 where it can be removed by the customer.

It is apparent that the locking and releasing mechanism is then in condition for a repeat operation with the parts occupying substantially the same rest position as described earlier herein with the exception that the latch engaging surface *b* of the rotor 120 then will be in engagement with the first latch means 121. It will be noted that, when the last newspaper A is dispensed from the apparatus, it becomes necessary to reload the unit. An attendant then may return pliable restraining means 70 to the position shown in FIG. 3 by inserting a lug 141 of a hand crank 140 into a correspondingly shaped cavity 142 provided in the outer end of shaft 113 (FIG. 11) and turning in a counter clockwise direction. Thereafter, further newspapers or the like may be placed in compartments 40' for later dispensing. A like operation may be appropriate for the restrainer means embodiment of FIG. 9.

It is thus seen that I have provided an improved apparatus for dispensing newspapers and the like, which apparatus can normally be operated, by operation of the locking and releasing mechanism heretofore described, only when a coin having been properly positioned in the coin mechanism 51. It is seen further that the apparatus comrises a housing in which article supporting means is positioned for supporting a stack or group of the newspapers to be dispensed therein with each such newspaper being inclined downwardly and forwardly at an angle, and wherein, upon each successive newspaper being dispensed, it is readily available to the customer without any need for the customer to open any doors or the like to gain access to the dispensed newspaper. On the other hand, the customer will not have access to the newspapers still in the storage unit compartments when a newspaper is dispensed into the chute 27. It can also be seen that article restraining means is moved incrementally in response to each cycle-effecting operation of the hand-operated actuator so as to move away a predetermined distance out of engagement with the front edge of the next adjacent newspaper then in the article supporting means 40 and to permit such newspaper to gravitate forwardly out of its compartment 40' and fall to chute 27 where it may be manually removed by the customer.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. Apparatus for dispensing articles such as newspapers, magazines and the like comprising:

a housing;

b. support means received in said housing for separately receiving and holding articles to be dispensed, said articles being maintained at a downwardly inclined angle to permit gravitational dispensing when unrestrained;

c. pliable restraining means located immediately adjacent a dispensing end of said support means along opposite edges thereof only and being held thereat against any substantial lateral movement, said restraining means being engageable with said articles to be dispensed along the edges of same only; and d. a stationary, restraining means drive means located adjacent one end of said article support means and being operatively connected to said restraining means, said drive means being actuatable to move said pliable restraining means a predetermined distance whereby one article only will become unrestrained and is dispensed.

2. Apparatus as defined in claim 1 wherein said support means comprises a plurality of separate angularly disposed compartments, open from the rear to permit loading of same with articles to be dispensed.

3. Apparatus as defined in claim 1 wherein said support means has at least one slot extending completely therethrough, and wherein said restraining means passes through said slot.

4. Apparatus as defined in claim 1 wherein said pliable restraining means comprise a pair of metal tapes, one located on each side of said support means, being engageable with said articles only along outer front edges thereof.

5. Apparatus as defined in claim 4 wherein said drive means is a rotatable shaft, and said tapes are secured for winding therearound, said tapes having a cable secured at an opposite end thereof, said cable passing around a guide at an end of said support means and returning along said support means and being received around said rotatable shaft.

6. Apparatus as defined in claim 1 wherein said pliable restraining means is a steel tape and wherein said tape has a cable means secured thereto and combining with said tape to form a closed loop.

7. Apparatus as defined in claim 6 wherein said cable is secured to both ends of said tape and said tape and said cable extend substantially around said support means.

8. Apparatus as defined in claim 6 wherein said cable means is secured to opposite ends of said steel tape and said loop passes around a plurality of guide means, at least one of which is a rotatable pulley and serves as said drive means.

9. Apparatus as defined in claim 1 wherein said restraining means is a tape which is secured at one end to said drive means and at an opposite end to a cable means, and wherein said cable means is also secured to said drive means, said drive means being a rotatable shaft having a weighted member wound thereon which continuously imparts a torque to said shaft, and wherein said shaft is operatively associated with a locking and releasing mechanism, said mechanism being operable to permit a predetermined rotary movement under the bias of said weight member to permit dispensing of one article at a time.

10. Apparatus as defined in claim 1 wherein said drive means is operatively associated with a one way clutch means for releasing said shaft for limited rotation only, said one way clutch means being operatively associated with a coin deposit mechanism whereby said clutch means is actuatable after deposit of a predetermined amount of money into said coin mechanism.

11. Apparatus as defined in claim 9 wherein said rotatable shaft is torque weighted and has a restraining tape and cable received at opposite ends thereof, each restraining tape being disposed at an opposite edge of the articles to be dispensed.

12. Apparatus for dispensing articles such as newspapers, magazines and the like comprising:

a. a housing;

b. article support means received in said housing, said support means having a plurality of vertically aligned, inclined single article receiving compartments therein, said support means further having a restraining means guideway located at each end of a dispensing end of said compartments;

c. a pliable restraining means received in each said guideway adjacent the dispensing end of said support means compartments and being located and held against substantial lateral movement at an end of said compartments only, said pliable restraining means being moveable along said ends of said compartments to permit dispensing of articles therefrom;

d. a stationary, rotatable shaft provided adjacent one end of said support means, said shaft having one end of said pliable restraining means secured thereto, said shaft further having a weighted member wound therearound, said weighted member imparting a continuous torque thereto, said shaft being normally restrained against rotary motion; and e. locking and releasing means associated with said shaft for permitting limited rotary motion of said shaft at a predetermined time, whereby said restraining means releases one article for dispensing at a time.

13. Apparatus as defined in claim 12 wherein said restraining means comprises a tape and wherein a cable is secured to an end of said tape opposite said shaft, said cable having one end thereof also secured to said shaft and being under spring tension thereat.

14. Apparatus as defined in claim 13 wherein said guideway comprises a plurality of separate guide bars located in front of said compartments along the edge thereof.

15. Apparatus for dispensing articles such as newspapers, magazines and the like comprising:

a. a housing;

b. article support means received in said housing, said support means having a plurality of vertically aligned, inclined single article receiving compartments therein;

c. a pair of restraining tapes positioned in front of said support means, said tapes extending across a portion of the front of said compartments to restrain an article from falling therefrom, said tapes being jointly moveable in increments along said support means to uncover said compartments one by one;

d. a stationary, rotatable shaft provided adjacent a top of said support means and having an end of said tapes secured thereto; said shaft having a weighted element wound therearound, whereby a torque is applied on said shaft;

e. a cable means secured to each tape at an end thereof opposite said shaft, said cable means passing around guide means and being secured under spring tension to said shaft adjacent said tapes;

f. a latch and release mechanism operatively associated with said shaft for normally holding said shaft against the force of said torque to prevent rotation of same and releasing said shaft at a predetermined time to permit said torque to rotate said shaft a limited amount only whereby said tapes move a limited amount and uncover a single compartment to permit dispensing therefrom; and g. a coin receiving mechanism operatively associated with said latch and release mechanism, said coin mechanism actuating said release mechanism upon receipt of proper coinage therein only.

* * * * *